US005403108A

United States Patent [19]

Karlis

[11] Patent Number: 5,403,108

[45] Date of Patent: Apr. 4, 1995

[54] IN BINDER PUNCH

[75] Inventor: Robert G. Karlis, Hingham, Mass.

[73] Assignee: Clix Products, Inc., Natick, Mass.

[21] Appl. No.: 156,242

[22] Filed: Nov. 22, 1993

[51] Int. Cl.[6] ..... B42F 13/40

[52] U.S. Cl. ..... 402/1; 402/4; 30/358; 83/597

[58] Field of Search ..... 402/1, 4; 30/358, 360, 30/361, 363; 83/597, 605

[56] References Cited

U.S. PATENT DOCUMENTS

| | | | |
|---|---|---|---|
| 829,837 | 8/1906 | Brisacher . | |
| 1,142,032 | 6/1915 | Faifer . | |
| 1,191,680 | 7/1916 | Farrow | 30/358 |
| 1,292,124 | 1/1919 | Stenquist | 30/358 |
| 1,312,492 | 8/1919 | Prouty | 30/358 |
| 1,465,531 | 8/1923 | Smith et al. | 30/358 |
| 1,567,643 | 12/1925 | Hearne . | |
| 2,139,159 | 12/1938 | Hammen . | |
| 2,370,319 | 2/1945 | Lippincott . | |
| 2,445,440 | 7/1948 | Klemm | 402/1 |
| 2,495,687 | 1/1950 | Belmont . | |
| 3,000,049 | 9/1961 | Terry, Jr. . | |
| 3,172,325 | 3/1965 | Wernham . | |
| 3,372,482 | 3/1968 | Mercorelli . | |
| 3,408,889 | 11/1968 | Murphy . | |
| 3,975,105 | 8/1976 | Cline . | |
| 4,218,599 | 8/1980 | Garn . | |
| 4,869,143 | 9/1989 | Merrick et al. . | |
| 4,893,535 | 1/1990 | Bentrim et al. . | |
| 4,893,978 | 1/1990 | Frano . | |
| 4,941,381 | 7/1990 | Garner . | |
| 4,973,212 | 11/1990 | Jacobs . | |

FOREIGN PATENT DOCUMENTS

| | | | |
|---|---|---|---|
| 258376 | 2/1964 | Australia | 402/1 |
| 1016630 | 1/1966 | United Kingdom . | |
| 2209133 | 5/1989 | United Kingdom . | |

*Primary Examiner*—Mark Rosenbaum
*Assistant Examiner*—David P. Bryant
*Attorney, Agent, or Firm*—Morse, Altman, Dacey & Benson

[57] ABSTRACT

A paper punch for use in combination with either a notebook having a pair of covers and a spine therebetween or with a ruler. The paper punch essentially comprises a punching element of unitary construction and formed of a hard yet resilient plastic material, preferably by injection in a mold. The punching element is formed with a pair of parallel spaced arms resiliently connected to one another at one end and featuring male and female punching members respectively disposed on the arms in operative association with each other. A slit is formed in one of the arms in a plane normal to the punching members and bisecting the female punching member. In a normally inoperative position, the male punching member is partially disposed within its cooperative female member in close proximity to the slit, and in an operative position, the male punching member is fully disposed within its cooperative female member, traversing the slit. Preferably, cooperating alignment members also are formed on the arms to secure the alignment of the punching members.

4 Claims, 4 Drawing Sheets

IN BINDER PUNCH

BACKGROUND OF THE INVENTION

1. Field of the Invention

The present invention relates generally to devices for perforating sheets of paper for insertion in loose-leaf ring binders and, more particularly, to a paper punch for use in combination with a loose-leaf notebook or a ruler.

2. The Prior Art

Devices for perforating sheets for insertion in loose-leaf ring binders and adapted to be carried therein have been around for a long time. Faifer disclosed such a combined perforator and binder in 1915, see his U.S. Pat. No. 1,142,032. Improvements followed. See U.S. Pat. Nos. 1,567,643, granted to Hearne in 1925; 2,139,159, granted to Hammen in 1938, 2,370,319, granted to Lippincott in 1945; 2,495,687, granted to Belmont in 1950; and 3,172,325, granted to Wernham et al. in 1965, to name a few.

In a copending application Ser. No. 08/061,427, filed May 6, 1993, and assigned to a common assignee, Clix Products Inc., of Natick, Mass., there is disclosed a sheet perforating punch formed of hard polymeric material.

As known and as exemplified by the patents referred to above, it is advantageous to have a perforating device which is designed to be carried in a loose-leaf ring binder so that papers intended to be inserted therein can be punched immediately prior to insertion.

Most, if not all, perforating devices excepting the one disclosed in said copending application, were formed of metal for accurate long lasting punching use. As known, paper punches formed of plastic, as in said copending application Ser. No. 08/061,427, tend to wear rapidly as between the punch teeth and their corresponding die holes unless very strict registration is maintained therebetween. Maintaining such strict registration is and remains a difficult task, however. This problem is especially acute with respect to all plastic sheet perforating punches of present design in which the male punching member is designed to enter, from the top and at a slight angle, its corresponding female die hole.

SUMMARY OF THE INVENTION

It is principal object of the present invention to overcome the above disadvantages by providing an all plastic paper punch of novel construction that does not suffer from the troublesome tendency to wear rapidly as between its punch teeth and its corresponding die holes despite repeated and continuous use.

More particularly, it is an object of the present invention to provide a paper punch, formed from a hard yet resilient plastic, such as NYLON ®, for use in combination with either a notebook having a pair of covers and a spine therebetween or with a ruler. The paper punch of the invention, when depressed, punches upward unlike present day paper punches, all of which punch downward.

Essentially, the paper punch of the invention comprises a punching element, preferably affixed to one of the pair of covers of a notebook. The paper punch is of unitary construction and is preferably formed in a mold by injection forming techniques. The punching element is formed with a pair of opposed parallel spaced arms resiliently and operatively connected to one another at one end. Male and female punching members are respectively disposed on the pair of parallel spaced arms, in operative association with one another, with the male punching member being formed on the bottom arm and the female punching member formed on the top arm. A slit is formed in the top arm in parallel spaced relation to the arms and in a plane normal to the punching members. The slit effectively bisects the female punching member. In a normally inoperative position, the male punching member is partially disposed within its cooperative female member and in close proximity to the slit, without however intruding into the slit. When the top arm is depressed against its underlying bottom arm, the male punching member becomes fully disposed within its cooperative female member, thus traversing the slit. A sheet of paper, previously inserted into the slit, thus becomes perforated thereby, with the cut-out part of the sheet of proper rising to the top of the top arm. Preferably, cooperating alignment members also are formed on the arms to secure the proper alignment of the arms to one another, and in particular, to secure the alignment of the punching members. In one embodiment, the surface of the top arm preferably is flat. In another embodiment, the surface of the top arm is formed with raised edges, preferably all around its periphery. As a consequence, the top arm features a central depressed flat portion around the female die hole, allowing thereby the collection of a plurality of cut-out portions from a multiplicity of sheets of paper perforated thereby. These cut-out portions of perforated sheets are then later conveniently removed by moving the notebook cover upside down. Also preferably, at least one edge of the raised edges is formed at an acute angle toward the slit. A connecting cover member formed with a corresponding re-entrant edge, is designed releasably and operatively to connect a plurality of punching elements affixed in a row on the notebook cover. The connecting cover member allows the convenient perforation of one or more sheets of paper in one operation. The connecting cover member, when removed from the plurality of punching elements, also serves as a ruler. Preferably, one or more of the punching elements also can include a pencil holder, also formed integrally therewith. The punching elements can be affixed to one of the pair of notebook covers in any known manner, including using an adhesive or a pair of fasteners, such as studs, securely connecting each of the punching elements to the notebook cover. In a further embodiment, the plurality of punching elements are releasably and operatively connected to a free-standing ruler.

Other objects of the present invention will in part be obvious and will in part appear hereinafter.

The invention accordingly comprises the paper punch for use in combination with either a notebook or a ruler of the present disclosure, its components, parts and their interrelationship, the scope of which will be indicated in the appended claims.

BRIEF DESCRIPTION OF THE DRAWINGS

For a fuller understanding of the nature and objects of the present invention, reference is to be made to the following detailed description, which is to be taken in connection with the accompanying drawings, wherein.

DETAILED DESCRIPTION OF THE PREFERRED EMBODIMENTS

In general, the present invention pertains to devices for perforating sheets of paper for insertion in loose-leaf ring binders and, more particularly, to an all plastic paper punch for use in combination with either a notebook having a pair of covers and a spine therebetween or with a fee-standing ruler.

The paper punch, in combination, essentially comprises a punching element formed of unitary construction of a hard yet resilient plastic material, such as NYLON®, preferably by injection forming in a mold. The punching element basically is formed, when assembled for use, with a pair of parallel spaced arms resiliently connected to one another at one end. Male and female punching members are respectively disposed on the pair parallel spaced arms and in operative association with one another. A slit, designed to receive an edge of a sheet or sheets of paper to be perforated, is formed in one of the pair of parallel spaced arms in a plane normal to the punching members and bisecting the female member. The male punching member always is partially disposed within its cooperative female member and in close proximity to the slit. This represents the quiescent, normally inoperative state of the punching element. With an edge of a sheet or sheets of paper to be perforated inserted into the slit, the resiliently connected top arm is depressed by an operator with the result that the male punching member becomes fully disposed within its cooperative female member, traversing thereby the slit and effecting the desired perforation in the therein inserted sheet or sheets of paper, punching in an upward direction and ejecting the punched out part up and through the female member. This represents the second or operative state of the punching element. When the operator releases the downward force exerted on the resiliently connected top arm of the pair of parallel spaced arms, the arms once again assume their normally parallel spaced position due to their being resiliently connected to one another. Consequently, the male punching member recedes from the slit and assumes its normally inoperative state by being only partially disposed within its cooperative female member and in close proximity to the slit. Preferably, cooperating alignment members also are formed on the pair of parallel spaced arms adjacent their resilient connection to one another so as to secure and securely to maintain the precise alignment of the punching members. Minimal friction is thus generated between the punching members, greatly reducing undesirable wear and assuring a device of long lasting usefulness.

The Embodiment of FIGS. 1–4

A preferred embodiment of the invention is illustrated in FIGS. 1–4.

Figure 1:
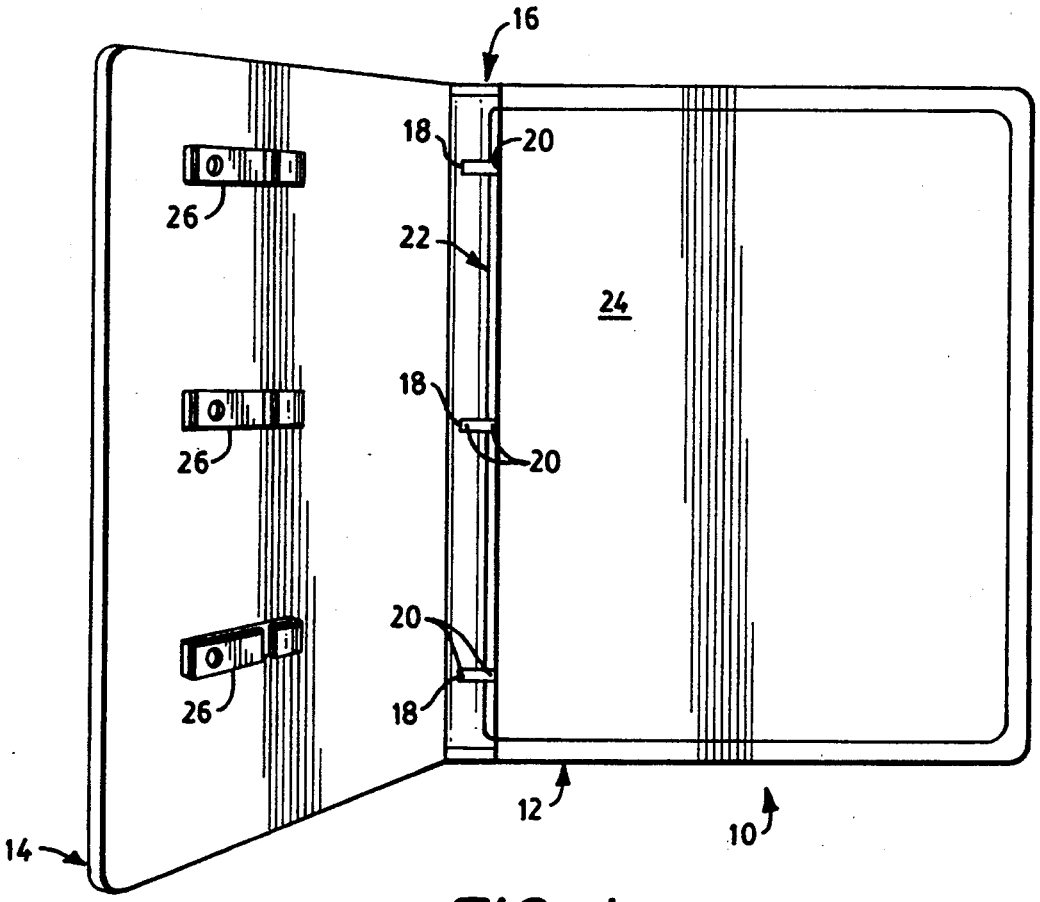
FIG. 1 is a perspective view of a loose-leaf notebook having a pair of covers with a spine therebetween and illustrating a plurality of punching elements affixed to one of the pair covers.

FIG. 1 is a perspective view of a loose-leaf notebook 10 having a pair of covers 12, 14 with a spine 16 therebetween. The spine 16 features a plurality of rings 18, which can be forced apart, as known, to receive for impalement thereon a plurality of punched openings 20 formed in an edge 22 of a sheet of paper 24.

A plurality of punching elements 26 are affixed to the inside of the cover 14 in spaced registry with the plurality of rings 18 and parallel to the spine 16. The punching elements 26 can be affixed to the inside of the cover 14 in any known manner, including via the use of an appropriate adhesive.

Figure 2:
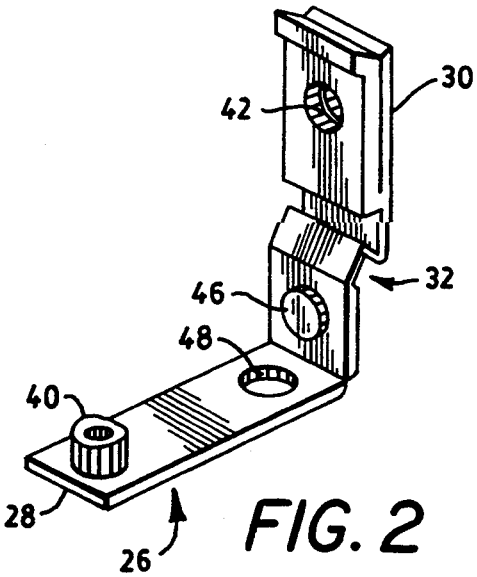
FIG. 2 is a perspective view, on an enlarged scale, of one of the punching elements.
Figure 3:
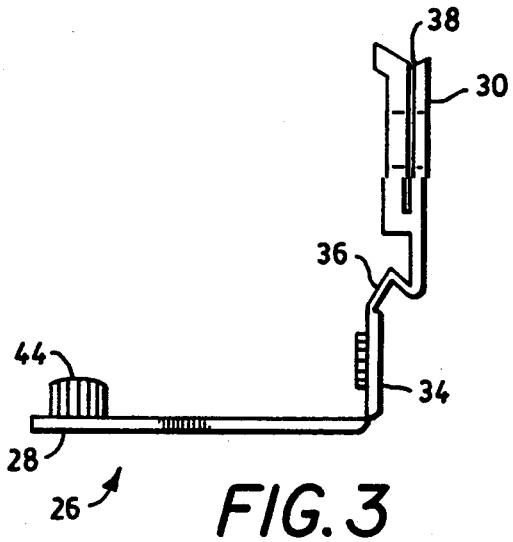
FIG. 3 is a side elevation of the punching element of FIG. 2.
Figure 4:
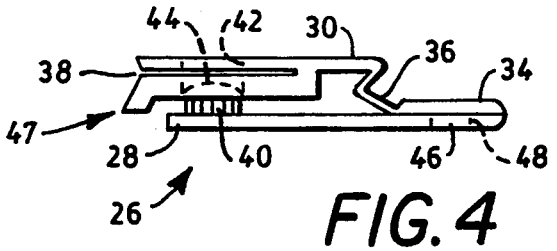
FIG. 4 is a side elevation of the punching element of FIG. 2 in assembled condition preparatory to it being affixed to one of the pair of covers.

FIGS. 2–4 illustrate, on an enlarged scale, the construction of one punching element 26.

As mentioned, the punching element 26 is of unitary construction, formed of a hard yet resilient plastic material, such as NYLON®, preferably by injection forming in a mold, not shown. The punching element 26 basically is formed of two arms 28 and 30 connected to one another at one end by a resilient segment 32. Resilient segment 32 is itself formed of two sections: a first section 34 and a second thinner and bent section 36. It is this thinner and bent section 36 that provides for the resiliency existing between the pair of parallel spaced arms 28, 30 when in the assembled state, as illustrated in FIG. 4. A slit 38 is formed substantially along the length of the top arm 30 and in parallel therewith. Male and female punching members 40 and 42, respectively, are formed in the respective arms 28 and 30. The male punching member 40 preferably features sharp arcuate cutting edges 44.

Preferably, suitable alignment members 46 and 48 also are provided on the arms 28 and 38. The protruding alignment member 46 is disposed on the first flat section 34 of the resilient segment, with the corresponding alignment member 48, a hole, disposed on the bottom arm 28, representing a reversal of sorts when compared to the punching members 40 and 42, observe FIG. 2.

FIG. 4 illustrates the punching element 26 in its assembled condition preparatory to its being affixed to the inside of the cover 14 of the loose-leaf notebook 10. As mentioned, any known technique can be used to affix one or more punching elements 26 to the cover 14, including using a suitable adhesive provided at the underside of the bottom arm 28 of the punching element 26.

As evident from viewing FIG. 4, the flat section 34 lies flat against the upper surface of the bottom arm 28. Due to the shape and construction of the thinner bent section 36, the two arms 28 and 30 are both superimposed on each other and in parallel spaced relation to one another. As also evident from FIG. 4, the top arm 30 juts out as at 47, somewhat over and is thus longer than the bottom arm 28.

The fully assembled condition of the punching element 26, illustrated in FIG. 4, also represents a first inoperative position thereof in which the male punching member 40 is partially disposed within its cooperative female punching member 42 and in close proximity to the slit 38. More precisely, the sharp arcuate cutting edge 44 of member 40 is located just below the slit 38. As mentioned, by first inserting an edge of one or more sheets of paper into the slit 38 and then depressing the top arm 30 against the bottom arm 28, the male punching member 40 is caused to punch upward, traversing the slit 38 and thereby perforating the sheet or sheets of paper inserted therein. The distance of this upward punching is delimited by the distance separating the two superimposed parallel spaced arms 28 and 30 from one another as illustrated in their first inoperative position. In this second operative position, the male punching member 40 is fully disposed within its female punching member 42, with the sharp arcuate cutting edge 44 thereof being now in close proximity to the top surface of the top arm 30. Upon release of the downward pressure by the first operator, required to assume the first operative position of the punching element 26, the inherent elasticity of the bent section 36 will cause once again the separation of the pair of arms 28 and 30 from one another so as to assume their normally parallel spaced position.

The Embodiment of FIGS. 5–11

A second preferred embodiment of the invention is illustrated in FIGS. 5–11.

Figure 5:
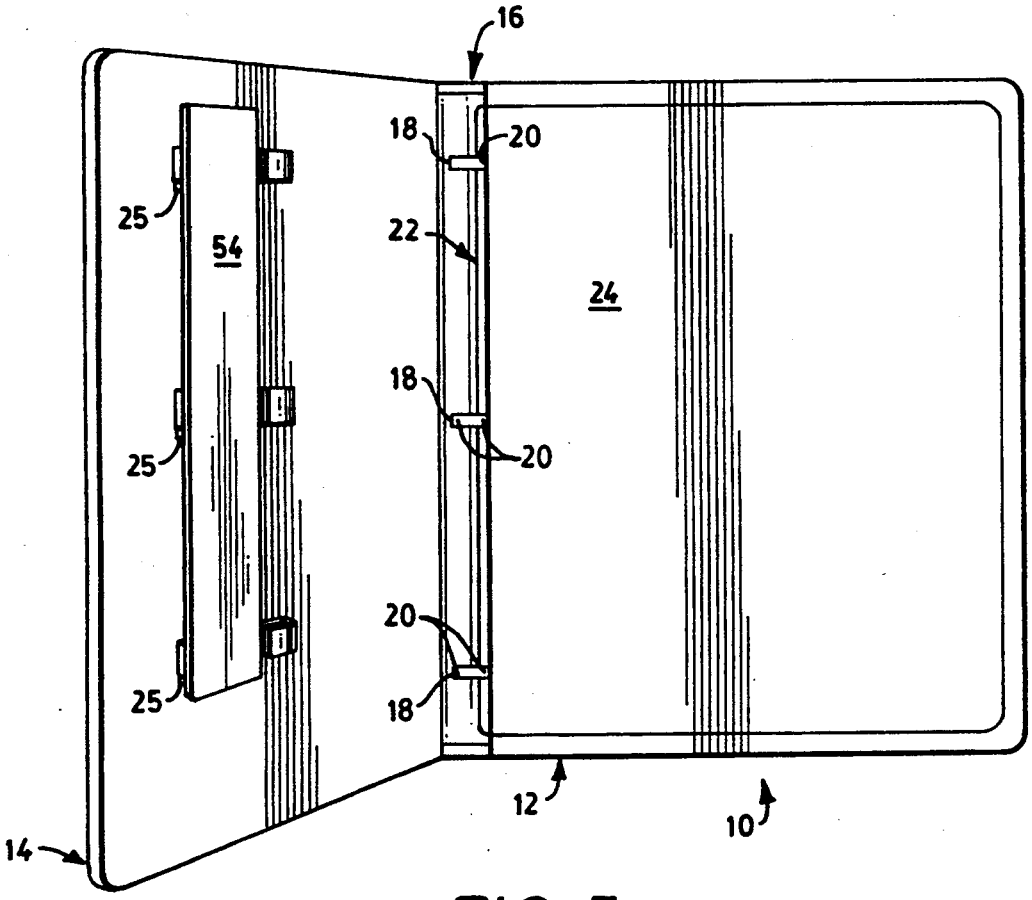
FIG. 5 is a view similar to FIG. 1 but illustrating another embodiment of the invention.

FIG. 5 is a view similar to FIG. 1 and illustrates, in perspective, the loose-leaf notebook 10 having a pair of covers 12, 14 with a spine 16 therebetween. The spine 16 features a plurality of rings 18, which can be forced apart, as known, to receive for impalement thereon a plurality of punched openings 20 formed in an edge 22 of a sheet 24 or sheets of paper.

A plurality of punching elements 25 are affixed to the inside of the cover 14 also in spaced registry with the plurality of rings 18 and parallel to the spine 16. Punching elements 25 preferably are affixed to the inside of the cover 14 by a pair of studs 50, 50 reaching through and connecting with the punching elements 25 via a pair of holes 52, 52 formed in the cover 14, as may be best observed in FIG. 9. The plurality of affixed punching elements 25 are operatively connected to one another by a connecting cover 54. By depressing the connecting cover 54, each of the punching elements 25 is rendered operational, as more fully described below.

Figure 6:
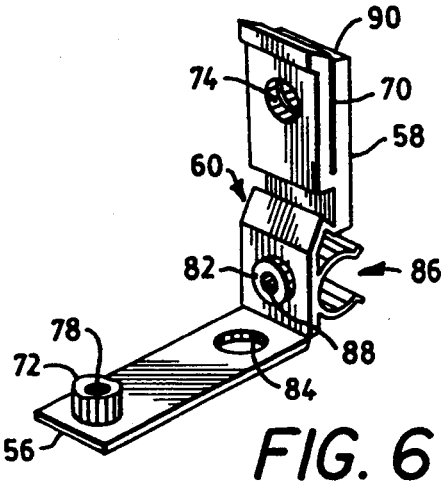
FIG. 6 is a view similar to FIG. 2 but showing a punching element according to the embodiment of FIG. 5.
Figure 7:
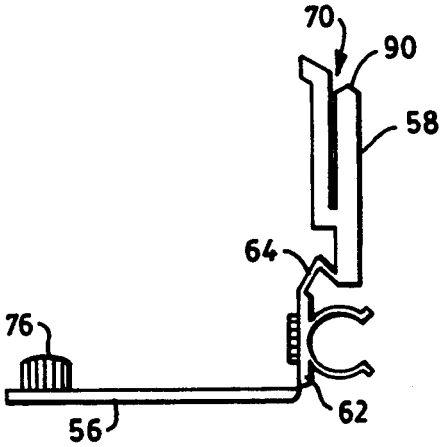
FIG. 7 is a view similar to FIG. 3 but illustrating the punching element of FIG. 6.
Figure 8:
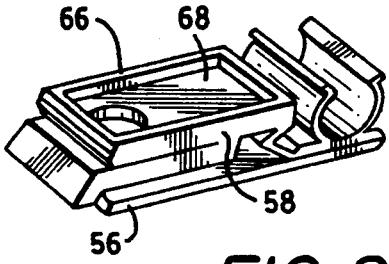
FIG. 8 is a perspective view of the punching element of FIG. 6, in an assembled condition.
Figure 10:
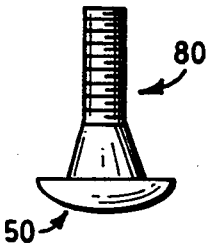
FIG. 10 illustrates in elevation one of the pair of fastening elements illustrated in FIG. 9.
Figure 11:
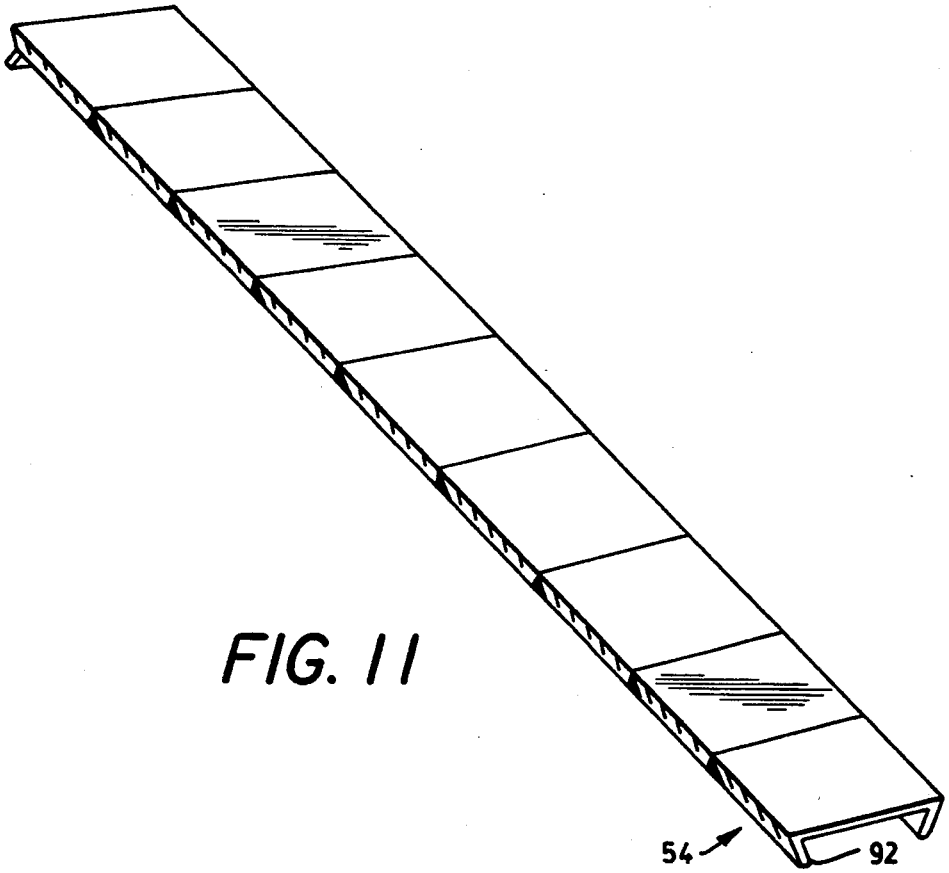
FIG. 11 is a perspective view of a connecting cover used in combination with the second embodiment of the invention illustrated in FIG. 5.

FIGS. 6–8 illustrate, on an enlarged scale, the construction of one punching element 25.

Figure 9:
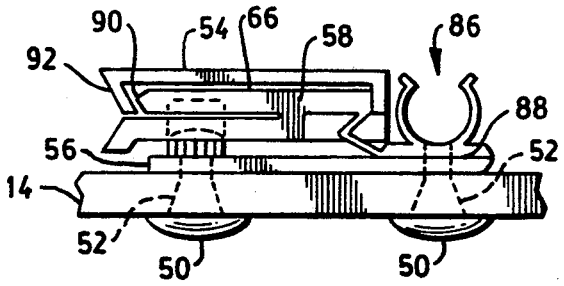
FIG. 9 is a view similar to FIG. 4 but showing the embodiment of FIG. 5, affixed via a pair of fastening elements, to a notebook cover.

The punching element 25 also is of unitary construction, formed of a hard yet resilient plastic material, such as NYLON ®, also preferably by injection forming in a mold, not shown. Punching element 25 also comprises two arms 56 and 58 connected to one another at one end by a resilient segment 60. Resilient segment 60 also comprises two sections: a flat section 62 and a thinner bent section 64. Again, it is this thinner bent section 64 that provides for the required resiliency existing between the pair of parallel spaced arms 56 and 58 when in the assembled state, as illustrated in FIG. 8, prior to its being affixed to the cover 14, which is illustrated in FIG. 9.

The top arm 58 is thicker than the corresponding top arm 30 of the punching element 26 in that it is provided with raised edges 66 all around, defining a depressed flat surface 68 therebetween. The cut portions of the paper perforations are accumulated therein and may be conveniently cleared therefrom upon the removal of the connecting cover 54.

A slit 70 is formed substantially along the length of the top arm 58 and in parallel therewith but below the depressed flat surface 68 thereof. Male and female punching members 72 and 74 respectively are formed in the respective arms 56 and 58. The male punching member 72 also preferably features sharp arcuate cutting edges 76. In addition, the male punching member 72 also is at least partially formed with an internally-threaded portion 78 so as to accommodate therein an externally-threaded portion 80 of one of the pair of fastening studs 50, illustrated in FIG. 10. Suitable alignment members 82 and 84 also are preferably provided on the arms 56 and 58. In addition, the flat section 62 of the arm 58 also features a pencil holder 86 integrally formed therewith and the male alignment member 82. An internally-threaded portion 88, which is open to and communicates with the bottom of the pencil-holder 86, is formed centrally and axially through the male alignment member 82 and the flat section 62 of the arm 58, as may be best observed in FIGS. 6 and 9.

The raised edges 66, formed circumferentially about the top arm 58, also feature a front beveled edge 90 designed frictionally to engage a reentrant edge 92 of the connecting cover 54. Edges 90 and 92 combine to allow for the snap-fitting of the connecting cover 54 to each of the plurality of punching elements 25. Edges 90 and 92 also allow for the disengagement of the connecting cover 54 from these punching elements 25, allowing thereby for the removal of any accumulated cut fragments from the depressed flat surfaces 68 of the punching elements 25.

Figure 12:
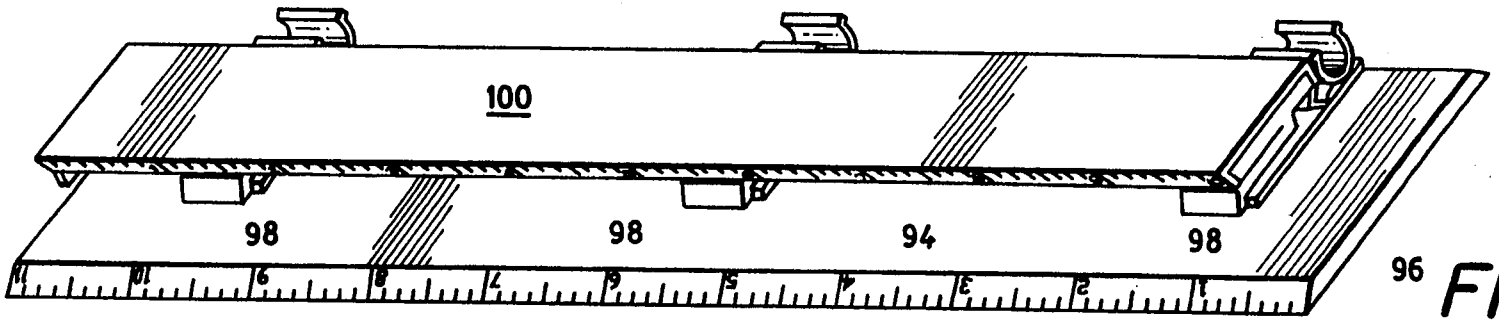
FIG. 12 is a perspective view of a paper punch for use in combination with a ruler, illustrating a third embodiment of the invention.
Figure 13:
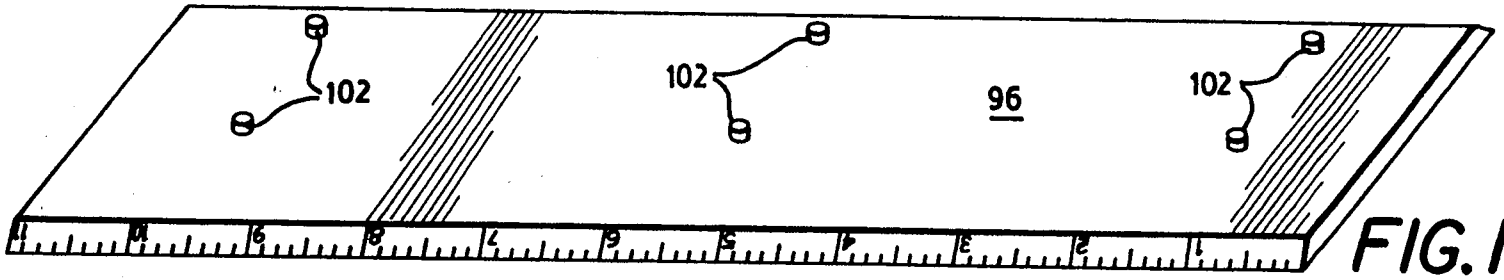
FIG. 13 is a perspective view of but one component part of the paper punch, illustrated in FIG. 12.

The Embodiment of FIGS. 12–13

A third preferred embodiment of the invention is illustrated in FIGS. 12 and 13.

In FIGS. 12 and 13 is illustrated a paper punch 94 for use in combination with a free-standing ruler 96. The paper punch 94 is, for all practical purposes, identical with the one shown in and disclosed with reference to FIGS. 5–11 excepting that the plurality of punching elements 98 are not now secured, as by a pair of studs 50, to the inside cover 14 of the loose-leaf notebook 10. Rather, the punching elements 98, together with their removable connecting cover 100 are now secured via pairs of projecting lugs 102 friction-fitting into corresponding holes, not shown, formed in the underside of the punching elements 98 centrally in the male punching members and in the male alignment members thereof, respectively.

Preferably, all component parts 96, 98 and 100 are also formed of the hard yet resilient plastic material, such as NYLON ®.

Thus it has been shown and described a paper punch for use in combination with either a loose-leaf notebook having a pair of covers and a spine therebetween or with a free-standing ruler, which paper punch satisfies the objects and advantages set forth above.

Since certain changes may be made in the present disclosure without departing from the scope of the present invention, it is intended that all matter described in the foregoing specification or shown in the accompanying drawings, be interpreted in an illustrative and not limiting sense.

What is claimed is:

1. A paper punch in combination with a notebook having a pair of covers and a spine therebetween, said combination comprising:

(a) a punching element affixed to one of said covers, said punching element being of unitary construction and including a male punching member and a female punching member respectively disposed in first and second superimposed arms resiliently connected to one another at one end of said punching element; and (b) a slit formed in said second superimposed arm in a plane normal to said punching members and bisecting said female punching member;

wherein said male punching member is partially disposed within said female punching member in close proximity to said slit when said punching element is in an inoperative state.

2. The combination of claim 1 wherein said punching element is movable between two positions: an inoperative position in which said male punching member is partially disposed within said female punching member in close proximity to said slit; and an operative position in which said male punching member is fully disposed within said female punching member and traverses said slit.

3. The combination of claim 1 wherein said punching element further includes alignment members for said superimposed arms formed adjacent said resiliently connected one end.

4. The combination of claim 1 wherein said punching element is formed of a hard yet resilient plastic material.

* * * * *